United States Patent [19]

Schieber

[11] 4,118,592

[45] Oct. 3, 1978

[54] CARBON ELECTRODE AND OTHER SHAPED CARBON BODIES

[75] Inventor: Franz Schieber, Röthenbach, Fed. Rep. of Germany

[73] Assignee: C. Conradty Nurnberg GmbH & Co. KG, Gruntal, Fed. Rep. of Germany

[21] Appl. No.: 734,006

[22] Filed: Oct. 19, 1976

[30] Foreign Application Priority Data

Dec. 4, 1975 [DE] Fed. Rep. of Germany ..... 2554606

[51] Int. Cl.[2] ..... H05B 7/07

[52] U.S. Cl. ..... 13/18 R

[58] Field of Search ..... 13/18; 313/332; 314/60

[56] References Cited

U.S. PATENT DOCUMENTS

| | | | |
|---|---|---|---|
| 1,058,057 | 4/1913 | Hinckley | 13/18 |
| 1,088,296 | 2/1914 | Richards | 13/18 UX |
| 2,527,294 | 10/1950 | Bailey | 313/332 |

*Primary Examiner*—R. N. Envall, Jr.
*Attorney, Agent, or Firm*—Gifford, Chandler, Van Ophem, Sheridan & Sprinkle

[57] ABSTRACT

A shaped body or structure of carbon, in particular a carbon electrode, preferably having a largely round cross-section and being provided in its surface with at least one slot extending in a generally longitudinal direction and extending to the inside of the structure. The slot is filled by a refractory filler material that substantially reduces the oxidation of the slot walls during operation of the electrode and which allows for variations of the slot width where a temperature gradient develops within the electrode cross-section because of temperature changes occurring during operation in an electric arc-furnace. The filler material is adapted as to its physical and chemical properties of the electrode material and is anchored within the slot.

21 Claims, 7 Drawing Figures

CARBON ELECTRODE AND OTHER SHAPED CARBON BODIES

BACKGROUND OF THE INVENTION

The present invention relates to a shaped body of carbon, in particular a carbon electrode, preferably having a largely round cross-section and being provided in its surface with at least one slot extending in a generally longitudinal direction and extending to the inside of the body.

Carbon electrodes have been utilized for many years in electro-thermal processes. There is widespread use of graphite electrodes in electric steel furnaces of graphitized as well as non-graphitized carbon electrodes for the manufacture of ferro alloys, calcium carbide, phosphorus, etc. The carbon electrodes in these processes serve to conduct electricity in which connection they are exposed to very high temperatures. For example, the tip of the graphite electrode in the steel furnace attains an average temperature of about 2000° to 2200° C. and for a short period a temperature above 3500° C. at the base of the electric arc.

Although carbon electrodes generally withstand these high temperatures due to the high sublimation point of carbon, which is at approximately 3500° C., disadvantageous effects can result primarily when the electrodes are subjected to very high alternating temperature stresses, so-called thermo-shocks. Such a thermo-shock occurs for example when the electrodes after tapping of an electric steel furnace, are withdrawn from the hot furnace and are exposed to the cold ambient air. The result in that case is a certain, extensive cooling and shrinking of the outer zone, and, thus, a high peripheral tensile stress. This very often then entails crack formations. Generally, such cracks develop irregularly, but there is an accumulation of them in the nipple regions, i.e. at the ends of the electrode where the cross-section is relatively weaker. Because of the usually higher coefficient of transverse thermal expansion of the nipple, the mechanical load of the electrode material becomes very high in these regions, apart from the weakening in cross-section, and may exceed the strength of the material. The cracks caused by thermo-shocks advesely affect the melting process because pieces of the electrode frequently break off, drop into the melt, and thus cause carburization of the melt. Further, cracked electrodes also are subject to greater burn-off, resulting in a great increase in electrode consumption per ton of steel.

DESCRIPTION OF THE PRIOR ART

In consideration of these drawbacks, attempts have been made for many years to improve the electrical load capability and the thermo-shock behavior of carbon electrodes by utilizing selected raw materials, such as premium cokes and needle cokes, which have low coefficient of thermal expansion and high thermal and electrical conductivity. However, the progress attained in that regard is not yet satisfactory as regards the thermal and electrical loading capability of the electrode for the furnace constructor and for the steelmaker. On the other hand, the suitable raw materials that are needed oftentimes, on account of an uncertain supply of crude oil, are either not on hand at all or are available only at excessively high prices, thus making the electrodes correspondingly more expensive.

It is already known (U.S. Pat. No. 2,527,294 for example) to provide carbon and graphite electrodes with slots, which have a width of approximately 0.4 to 12.7 mm. These slots, however, enlarge the oxidizable surface of the electrode. Due to the heavy oxidation on the inside of the electrode that is caused thereby, the affected surfaces of the electrode are rapidly worn off. In this manner the slot becomes continuously wider, thus continuously increasing the oxidation effect. The advantage thus attainable with such electrodes consisting of the relief of stress in the outer material zones and the improvement in thermo-shock behavior caused thereby is offset by the substantial drawback consisting of the considerable reduction in strength. Such electrodes have not found acceptance in actual practice in industry.

SUMMARY OF THE PRESENT INVENTION

It is therefore an object of the invention to provide a shaped carbon body and, in particular, a shaped graphitized or non-graphitized carbon electrode which exhibits a better thermo-shock behavior.

A further object of the invention is to eliminate the drawbacks which occur in the providing of slots, particularly the drawbacks of oxidation and burn-off as well as their undesirable consequences.

It is a further object of the invention to provide means for retaining a filler material in the slot of a shaped carbon body or structure, in particular a carbon electrode, so that the material does not fall out of the slot during operation of the electrode.

It is a further object of the invention to provide filler materials which are adapted for substantially reducing the oxidation of the slot walls during operation in an electric arc-furnace and to provide filler materials having physical and chemical properties suitable for carbon electrodes.

It is still a further object of the invention to provide a process for producing a shaped carbon structure, in particular a carbon electrode, which is of primarily round cross-section, and which is provided on its surface with at least one slot extending to the inside of the structure and in longitudinal direction.

These and other objects are accomplished according to the invention in that the slot is completely filled with heat-resistant filler material which considerably reduces the oxidation of the slot walls during operation of an electric arc-furnace, which material allows for changes in the slot width when a temperature drop occurs within the electrode cross-section on account of the temperature variations occurring in the operation of the electric arc-furnace, which is adapted as to its physical and chemical properties of the electrode material, and which is well anchored in the slot.

According to the invention the filling up of the slot, which is provided in the carbon electrode, with a heat resistant filler material has the effect of substantially closing the slot without losing the advantageous effects thereof with respect to the elimination of radial and tangential stresses in the case where a temperature drop occurs within the electrode material on account of rapid cooling of a heated electrode in the ambient air while, on the other hand, avoiding an oxidation of the opposing slot walls and the disadvantageous results which this has.

According to a preferred embodiment of the invention, it has turned out to be particularly useful in that connection to have the slot extend radially and to have it extend if possible to the center axis of the electrode. Moreover, in its longitudinal extent the slot need not follow a rectilinear course but, rather, may extend helically across the surface of the electrode. With a view to as little manufacturing effort as possible, the length of the slot can be selected such that the slot extends continuously from the one end face of the electrode to the opposite end face. The slot width and the slot depth need not necessarily be constat but, rather, may vary across the electrode length in adaptation to the material stresses to be expected.

It has proven to be useful for anchoring the filler material in the slot to provide the slot with at least one recess on its opposing surfaces, which recess advantageously is designed to have the form of at least one groove extending in longitudinal direction. This groove or these grooves may, for example, follow a sinusoidal course, so that the filler material, which also fills the groove when filled into the slot, is prevented solely by the configuration of the groove from slipping out of the slot again in axial or in radial direction. As regards the position of the groove, it has proven to be of advantage to provide it near the slot base.

Of the materials which have turned out to be best suited for the composition of the filler material, fibrous materials appear to be particularly well suited. Carbon fibers are well suited to this use and may be provided with an oxidation-inhibiting coating to prevent oxidation. Silicon carbide has turned out to be particularly well suited for the latter purpose. Other inorganic fibers such as aluminum silicate fibers are also preferred.

Furthemore, it has turned out to be of advantage to select a carbonaceous cement as filler material, which may also be pure carbon, but which does not adhere to the slot walls, so that it will not impair the change in slot width upon thermal expansion and contraction. However, inorganic cements have also provent to be serviceable in this connection.

The slot may also be filled with different filler materials, which either are positioned above one another in layers within the slot or, according to a further embodiment of the invention, are positioned behind one another in longitudinal direction within the slot.

The filler material is usefully inserted into the slot by being pressed into it, so that the filler material in the slot forms a body that entirely fills out the slot.

A particularly advantageous possibility of filling the slot can result from the fact that the filler material has been selected as to its composition such that it is destroyed during operation of the electrode in the electric arc-furnace, and in particular is destroyed in the region of the electrode tip from which the electric arc emerges.

Further, the advantages attained by the design of the carbon electrode according to this invention not only relate to the operation of the finished electrode but can also be of substantial significance during manufacturing of the electrode. This is because thermo-shocks also occur, although in reduced form, after graphitization of the pre-burnt electrode, and material cracks may result therefrom. Thus, the gap that is filled with filler material may be provided in an early stage of manufacture of the electrode so as to improve the quality of the product and to reduce the error rate. The same applies for the occurrence of thermo-shock during and after burning of the green electrode.

BRIEF DESCRIPTION OF THE DRAWINGS

The foregoing and other features of the present invention will become more apparent upon consideration of the following description taken in connection with the accompanying drawings wherein.

Figure 1:
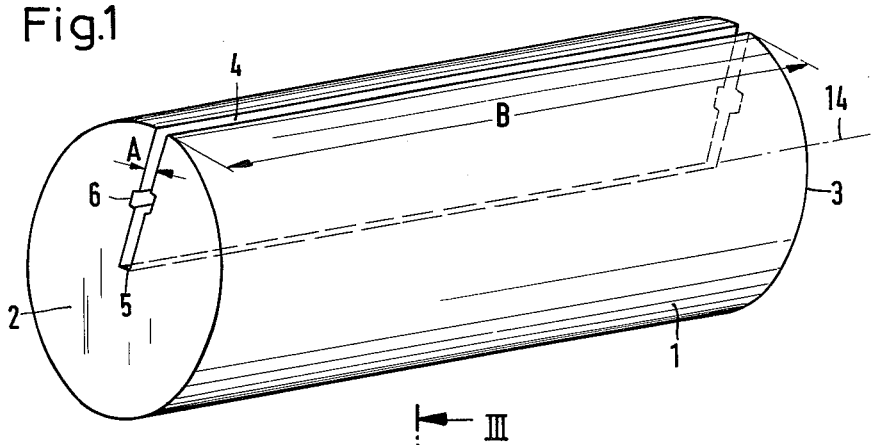
FIG. 1 is a diagrammatic representation of an electrode in perspective view, with a slot extending in longitudinal direction parallel to the axis.

A novel testing method was employed for testing the thermo-shock behavior of graphite bodies, and in particular, of carbon electrodes. In contrast to the conventional testing methods, which make it possible only to conductively or inductively heat small graphite discs centrally or peripherally, it is possible with this novel testing method to test within a few seconds large graphite discs having the form of electrode sections of a diameter of up to 600 mm. and a thickness up to 60 mm. The novel tests have shown that, when the graphite disc is heated, a large radial temperature gradient is developed which causes a radial crack to form, i.e. a crack from the cylindrical surface to the disc axis. The nature of the radial crack depends on the electrode material. For example, it was found that graphite discs made of high-grade premium coke will not crack until a higher radial temperature gradient in the manner as mentioned as opposed to graphite discs made of normal cokes.

Thus, the resultant radial crack is a tension relief crack, which can also be produced in the form of a longitudinally extending slot in the graphite disc or, respectively, in the electrode prior to thermally stressing the material.

It was found that graphite discs made of normal cokes that were provided with a slot which was filled with carbon fibers could no longer be caused to crack under thermal load which, in the absence of the filled slot, had led to the crack formation. Furthermore, it was determined that graphite discs made of normal cokes according to the invention exhibit a better thermo-shock behavior than non-slotted graphite discs made of premium or needle cokes.

In the cases in which a crack is developed, the crack is open to a width of approximately 3 to 6 mm. at the moment of a high radial temperature gradient at the periphery of the disc having a diameter of 450 mm. and, after the temperature equilization has been attained, it is closed again.

These tests have shown that a random crack development in shaped carbon structures or bodies and, in particular, in carbon electrodes when a temperature gradient occurs within the electrode cross-section (either on account of the heating and cooling of the material taking place on operation in the electric arc-furnace or during manufacture of the electrodes in the burning and graphitization process), can be avoided if the structures are previously provided with a stress-relief slot. The tests further showed that marked technical advantages are attained when these slots are filled with a heat-resistant filler material, which material reduces oxidation on the slot walls and does not bar the enlargement or decrease of the slot width that takes place on account of heating or, respectively, cooling of the material.

DESCRIPTION OF THE PREFERRED EMBODIMENTS

Now referring to the drawings:

The carbon electrode 1 shown in FIG. 1, and having a round cross-section, includes a radial slot 4, which extends to the center axis 14, so that the slot base 5 coincides approximately with the center axis. Furthermore, the slot 4 extends parallel to the center axis and extends over the entire electrode length B from the one end face 2 to the other opposing end face 3. In the case of the embodiment as shown, the slot width A is constant, but it may also vary over the slot length.

Figure 2:
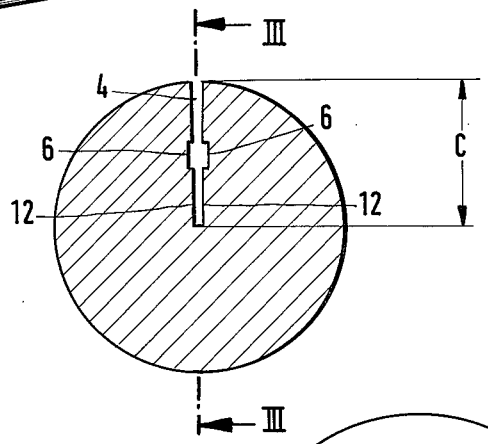
FIG. 2 is a radial sectional view of the electrode of FIG 1.
Figure 6:
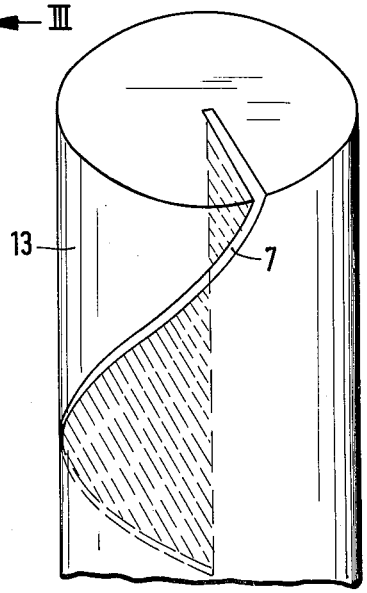
FIG. 6 is a perspective view of a part of a vertically positioned electrode, with a slot extending helically along the electrode surface.
Figure 3:
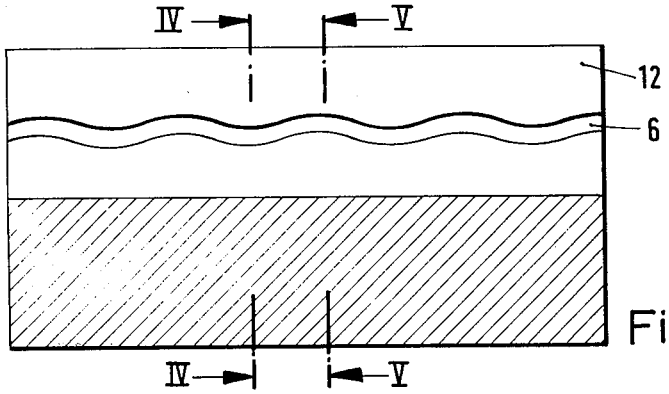
FIG. 3 is a longitudinal sectional view of the electrode of FIG. 1, taken in the direction of III—III of FIG. 2.

A distance corresponding approximately to the radius C, as shown in FIG. 2, has turned out to be particularly useful for the slot depth. However, advantage can be gained in cases in which the slot depth may be larger or smaller than the radius, or, respectively, in which it is not constant over the entire length. Theoretically, the slot width A should be as small as possible in order to avoid or minimize oxidation. However, the lowest theoretical limit may not be practical for reasons concerning the manufacturing technique. For example, reference is made to the slot designated by 7 in the embodiment shown in FIG. 6 where the slot extends helically along the surface of the electrode 13 from one end face of the electrode to the other. In this latter case, available manufacturing techniques play a part in determining the most suitable slot dimensions.

In order to minimize the usual disadvantageous effects which a slot has with respect to oxidation, i.e. the burn-off of the electrode in the region of the side walls of the slot, such as slot 4, the latter is completely filled with a refractory filler material 11 (FIGS. 4 and 5) which (a) allows for a change of the slot width A when a temperature drop occurs within the electrode cross-section on account of heating; which (b), as to its physical and chemical properties is adapted to the properties of the electrode material; and which (c) is well anchored within the slot. The filler material 11 is not securely connected to at least one of the side walls 12 and may consist of a fibrous material, e.g. carbon fibers, which may be provided with an oxidation inhibiting coating. Silicon carbide has proven to be particularly serviceable as such a coating.

However, other inorganic fibers, for example aluminium silicate fibers are particularly advantageous. Moreover, it is possible to select a carbonaceous cement for the filler material 11 instead of a fibrous material which cement may also consist of pure carbon. Inorganic cements have also proven to be good for this purpose.

The selection of a specific filler material depends to some extent on the purpose of use of the electrode and, thus, upon the operating conditions to which said electrode is subjected. It has turned out in that connection that under certain circumstances at least a partial destruction of the filler material during operation in the electric arc-furnace can be of advantage when this provides for the possibility of control, within a desired degree, of the oxidation or the burn-off of the electrode. Due to such destruction of the filler material the slot is exposed, so that its walls 12 oxidize. If this occurs within an approximately, previously calculable, predetermined operating cycle, it is possible thereby to attain a control of the burn-off at least within a certain scope. In that respect, the site of the destruction of the filler material is primarily within the zone of the electrode tip, from which the electric arc emerges.

Thus, the filler material has the important function (a) to maintain the slot preventing the formation of tension cracks closed during the isothermic heating of the electrode in order to thereby limit the oxidation of the slot walls to a minimum, if not to entirely avoid it, and (b) to allow for only a short-time opening of the slot in case of existence of a radial temperature gradient, so that in this case also the oxidation of the slot walls is kept as low as possible. Tests have shown that a reduction in consumption by more than 10% can be attained with carbon electrodes designed according to the present invention, without having to put up with the drawbacks of the oxidative slot wear-off and the mechanical weakening of the slot surroundings. In this way it becomes possible to produce many graphite electrodes, which so far had to be produced from expensive premium or needle cokes, from the substantially less expensive normal cokes. The quality of the filler material of the slot; which slot can be produced for example by a grinding operation in the graphitized, green, or burnt electrode and may have a width of for example 10 mm; should be such that it can retain its elasticity also during electrode operation. For this purpose, the already mentioned fibrous materials can be used as filler material, but it is also possible to use refractory wool, kaowool, and a large number of other materials.

Organic or carbon-forming binders may be added to the fibers to make the fibrous materials adhere to the slot walls, which binders do not reduce the elasticity of the fibers. In this manner, when the slot is opened, such as in case of high radial temperature gradients, the slot remains filled. It is also possible to connect the fiber fillings with the slot walls by suitable cements or adhesive subtances.

If cement is used as filler material, said cement may also be provided with a suitable binder. Also different filler materials can, for the purpose of filling out the slot, be stamped down into the slot in layered formation. For example, the lower slot portion can be filled with a carbon cement and the slot portion disposed thereabove with a carbide-containing cement. In this connection these various materials may also be alternated several times. Thus, a multiple layer arrangement within the slot can be made. The advantage which such layer-wise filling of the slot provides resides in that the oxidation of the carbon cement is prevented by the inorganic filler layers which are not or are poorly oxidizable. In principle, the cement used as filler material is adjusted such that its shrinkage during firing is nearly zero. This can be done, for example, by using suitable, curable synthetic resins as binders. In this manner, the fired slot filling may be just movable without a visible distance occurring between filler material and slot wall. This means that the width of the slot, ground or cut into the electrode while it is in green state, has been reduced to about "zero," so that the electrode when ready for operation after the graphitization process has an apparently closed surface.

Figure 4:
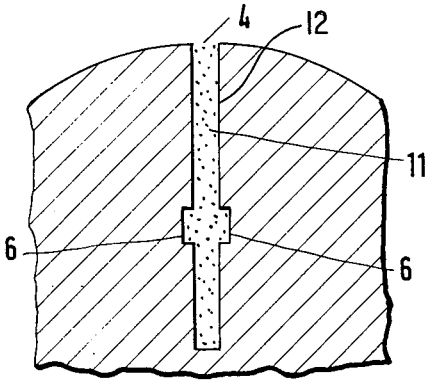
FIG. 4 is a partial radial sectional view of the electrode of FIG. 1, taken along IV—IV of FIG. 3, with the slot being filled with a filler material.
Figure 5:
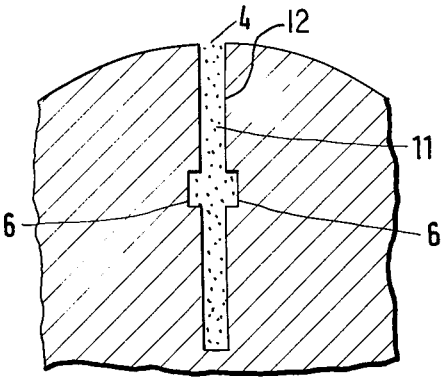
FIG. 5 is another partial radial sectional view of the electrode of FIG. 1, taken along V—V of FIG. 3, with the slot being filled with a filling material.

In order to improve anchoring of the filler material 11 within the slot as in FIG. 4, it has turned out to be of advantage to form a depression 6 in at least one of its opposing side walls 12, into which depression of the filler material is urged when being stamped down into the slot. The depression 6 thus defines a holding means for the filler material which prevents the material from falling out of the slot in radial as well as in axial direction in case there is a radial temperature gradient and an opening of the otherwise "zero" slot. Such a depression can be milled into one or into both slot walls, and it may, for example, have the configuration of a longitudinally extending groove 6 (FIGS. 2, 4, 5). Such a groove is particularly valuable if it extends sinusoidally along its longitudinal course. This sinusoidal course actually makes sure that the filler material of the slot that was also urged into the groove 6 cannot move axially out of the slot. Similarly such depressions can be put into slots such as slot 7 which extends helically along the surface of an electrode, such as is shown for example in FIG. 6.

An additional advantage of slots with such depressions resides in the fact that the carbon electrode is relaxed also in axial direction, thus improving its thermal shock behavior. It is to be pointed out in this connection that an electrode provided with a helical slot 7 (FIG. 6) functions like a spring and is also able to better withstand torsional stresses. In that respect, the helical slot may extend to a varying width about the cylindrical electrode surface, for example to 90°, 180° or more, depending upon the strength and the thermal loading capability of the electrode material.

Figure 7:
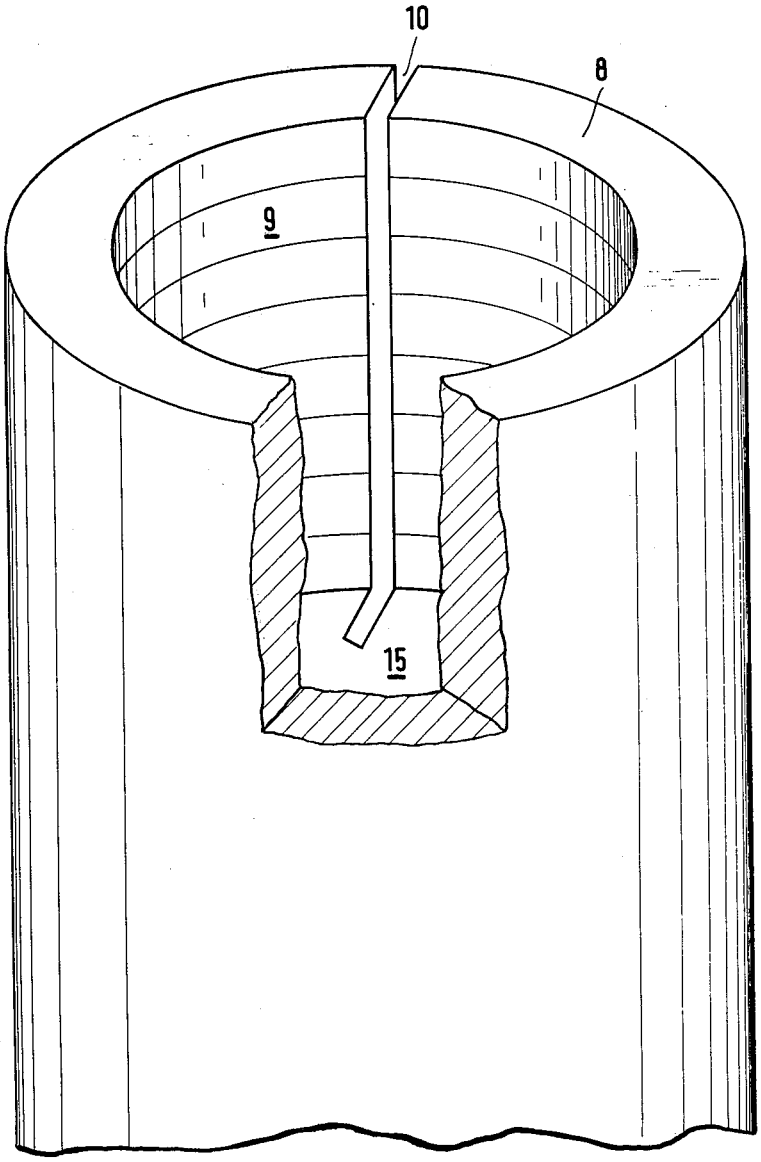
FIG. 7 is a perspective view on an enlarged scale, and partially cut away, of the nipple portion of an electrode having a longitudinal slot.

FIG. 7 shows a perspective view of a slot 10 in the region of a nipple case of the electrode 8. The slot 10 completely cuts through the nipple case, completely through the thread 9, extends to the center of the case base 15 and thence through the electrode body in a manner such as has been illustrated in FIG. 1 The slot can be worked into the carbon electrode either prior to the graphitization process or into the green or pre-fired electrode. In all cases, the mentioned advantages then can be attained after the slot has been filled in the manner as described. Correspondingly, the production of the depressions or grooves in the slot walls also occurs either prior to firing or prior to or after graphitization. However, when producing and filling the slot prior to graphitization, an additional advantage is attained in that the filler material also is graphitized, thus improving its resistance to oxidation. However, care must be taken that the shrinkage of the filler material in the graphitization process is as low as possible and should not be substantially greater than the shrinkage of the green material of the electrode.

The graphitization of an already slotted electrode, particularly the graphitization of a slot, which has already been filled with a material of the type mentioned above, has the effect that the thermal load of the electrodes during the graphitization process and primarily in the subsequent cooling period leads to a substantially lower damage to the electrodes than when there is no slot filling.

If, however, the slot is put in the electrode before the actual burning process, that is, in the green state during or subsequently to the forming process, the slot will prevent crank formation caused by the radial temperature gradient that forms during the subsequent burning process. Otherwise, such crack formation is more probable because temperature increase is initiated at the cylindrical surface of the electrode. Consequently coking and shrinkage initiates at the surface and always is more advanced on the outside than on the inside of the electrode. Such initial outside shrinkage leads to peripheral tensile stresses. Therefore, a crack formation in prior art processes could not be avoided in the case of too rapid heating. If, however, the electrode is previously slotted, these peripheral tensile stresses can develop to a much lower extent, thus preventing undesirable crack formation. It also follows therefrom that electrodes which are thus slotted can be fired more rapidly, leading to additional economies in a production process.

If the slot is worked into the electrodes prior to the firing process, it may be filled with the filler material of the type as described above after burning as well as after graphitization as soon as the prerequisites necessary therefor are provided; for example, when a sinusoidal or other depression has been cut into the slot walls.

Prior to the present invention the production process of the carbon electrodes was made considerably complicated on account of the crack formations to be expected and the resulting damage to the electrodes during both production and use. The former optimization processes are difficult to carry through because, on the one hand, a fine-grained and dense electrode could be expected to have a higher strength, a better conductivity and a substantially better oxidation behavior but, on the other hand, had a greatly deteriorated thermo-shock behavior. Coarse-grained electrodes of lower density, though being relatively more shock-resistant, nevertheless very often do not meet the requirements of strength and oxidation resistance. Prior optimization of the production process which had to take into consideration the raw materials used therefore left considerable to be desired.

Now, however, electrodes provided with a slot of the type described can be made of fine-grained, high density-materials which not only are more resistant to oxidation and exhibit a better conductivity but, also exhibit an optimum thermo-shock behavior i.e. do not have a tendency to develop random cracks when a great temperature gradient occurs over the electrode cross-section. If the slot provided is filled with a filler material of the type described, oxidation is also provided within the slot, and moreover, the possibility is provided, depending on the type of the filler material and its position within the slot, to control the burn-off behavior of the electrodes in operation. This can be done for example in that the slot filling is burned off in the lower region of an electrode string over a desired period of time, which depends on the operation parameters, such as furnance size, electric load, ventilation, electrode advancement, etc. In this manner a slot extending to the electrode axis is then exposed and serves as additional radiation surface for an overheated electrode.

There is reason to believe that the high current intensities of 80 kA to 100 kA used today to some extent in electric steel furnaces and which will likely be increasingly required in the future, lead to temperatures within the hot electrode tips that are near the carbon sublimation point in electrodes having a diameter of 600 mm. Therefore, an open slot extending to the inside of the electrode has the effect of substantially thermally relieving the electrode tip, even under the projected future increased electric loading of the electrodes. Thus, even under such increases the random crack formation of the electrodes will be substantially decreased, if not entirely prevented.

Therefore, it may be stated in conclusion that by the design, according to the invention, of shaped carbon structures or bodies and, particularly, carbon electrodes no random crack formation occurs, but rather, the slot that is provided in the electrode constitutes a "pre-programmed" crack which, due to the fact that filler material is pushed in, eliminates the drawbacks that known designs of this type involve in that the effective slot width is reduced practically down to zero. Thus, the oxidation and burn-off behavior of the electrode comes close to that of the non-slotted electrode while at the same time, however, suppressing any crack formation.

The filler material used for the slot is not connected with at least one of the two opposing slot walls when it exhibits no elastic behavior. Thus, the filling of the slot is essential to the invention, particularly since stress-relief of the electrode is required only when high radial temperature gradients occur; for example when burning, graphitizing or when subsequently using the finished electrode in operation. The slot, which otherwise is necessary for relief, should be closed in the isothermic or nearly isothermic state which exists during more than 95% of the process time of the electrode, in order that no damage due to oxidation occurs on the electrode. This closing of the slot is attained only with the aid of the filler material of the type described.

I claim:

1. A shaped body of carbon, in particular a carbon electrode, having a largely round cross section:
   (a) said body being provided in its surface with at least one slot extending in longitudinal direction and to the inside of the body;
   (b) said body being provided with at least one depression extending inwardly from the surface of said slot; and
   (c) a refractory filler material substantially filling said slot and said depression;
   and wherein said filler material shields said surface of said slot against oxidation, allows for variations of the slot width when a temperature gradient develops within the electrode cross section, and wherein the filler material in said depression anchors the filler material in said slot.

2. A body as defined in claim 1 wherein said body is an electrode adapted for use in an electric furnace and wherein said filler material is adapted to be destroyed at temperatures generated during use near the electric arc end of said electrode.

3. A body as defined in claim 2 wherein the site of said destruction is within the region from which said arc emerges.

4. A body as defined in claim 1 wherein said body is an electrode provided with a nipple case and wherein said slot extends longitudinally along the surfaces of both said electrode and said nipple case.

5. A shaped body of carbon according to claim 1, in which said depression is designed as at least one groove extending in longitudinal direction.

6. A shaped body of carbon as claimed in claim 5 wherein both surfaces of the opposing walls of said slot include at least one groove.

7. A shaped body of carbon as claimed in claim 5 wherein said groove follows a sinusoidal course.

8. A shaped body of carbon as claimed in claim 5 wherein said groove is located near the slot base.

9. A shaped body of carbon as claimed in claim 1 wherein said slot extends helically over the surface of the electrode.

10. A shaped body of carbon as claimed in claim 1 wherein the width of said slot changes in longitudinal direction of the slot.

11. A shaped body of carbon as claimed in claim 1 wherein the depth of said slot changes in radial direction.

12. A shaped body of carbon as claimed in claim 1 wherein said filler material consists of carbon fibers.

13. A shaped body of carbon as claimed in claim 12 wherein said carbon fibers are provided with an oxidation inhibiting coating.

14. A shaped body of carbon as claimed in claim 13 wherein said oxidation inhibiting caoting consists of silicon carbide.

15. A shaped body of carbon as claimed in claim 1 wherein said filter material consists of inorganic fibers.

16. A shaped body of carbon as claimed in claim 15 wherein said inorganic fibers are aluminum silicate fibers.

17. A shaped body of carbon as claimed in claim 1 wherein said slot is filled with different filler materials.

18. A shaped body of carbon as claimed in claim 17 wherein these different filler materials are arranged within said slot in layers above one another.

19. A shaped body of carbon as claimed in claim 17 wherein said different filler materials are arranged within said slot in a manner in which they are disposed behind one another in longitudinal direction.

20. A shaped body of carbon as claimed in claim 1 wherein said filler material consists of a carbonaceous cement.

21. A shaped body of carbon as claimed in claim 1 wherein said filler material consists of an inorganic cement.

* * * * *

UNITED STATES PATENT AND TRADEMARK OFFICE

CERTIFICATE OF CORRECTION

PATENT NO. : 4,118,592
DATED : October 3, 1978
INVENTOR(S) : Franz Schieber

It is certified that error appears in the above-identified patent and that said Letters Patent are hereby corrected as shown below:

Column 1, line 44 delete "advesely" and insert --adversely-- therefor;
Column 3, line 7 delete "constat" and insert --constant-- therefor;
Column 3, line 36 delete "provent" and insert --proven-- therefor;

Column 10, line 31 delete "filter" and insert -filler-- therefor.

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*